US006019538A

United States Patent [19]

Whaley

[11] Patent Number: 6,019,538

[45] Date of Patent: Feb. 1, 2000

[54] CLINCH FASTENER FOR A RING BINDER

[75] Inventor: Paul Whaley, Herculaneum, Mo.

[73] Assignee: U.S. Ringbinder, St. Louis, Mo.

[21] Appl. No.: 09/168,473

[22] Filed: Oct. 8, 1998

[51] Int. Cl.[7] ..... B42F 13/00

[52] U.S. Cl. ..... 402/75

[58] Field of Search ..... 402/75, 80 R; 24/95, 94; 29/243.521

[56] References Cited

U.S. PATENT DOCUMENTS

| | | | |
|---|---|---|---|
| 5,035,526 | 7/1991 | Cooper et al. | 402/75 |
| 5,100,253 | 3/1992 | Cooper | 402/75 |
| 5,160,209 | 11/1992 | Schuessler | 402/75 |
| 5,755,513 | 5/1998 | To | 402/36 |
| 5,772,348 | 6/1998 | To | 402/75 X |
| 5,842,807 | 12/1998 | To | 402/36 |
| 5,903,958 | 5/1999 | Whaley | 402/75 X |

*Primary Examiner*—Willmon Fridie, Jr.

*Attorney, Agent, or Firm*—Polster, Lieder, Woodruff & Lucchesi

[57] ABSTRACT

A fastener (50) fastening a paper retaining binder mechanism (18) to a binder (10). A plate (52) is deformable to attach the fastener to the binder mechanism by abutting the plate against the binder mechanism and then striking the binder mechanism with a tool (T) which deforms a portion of the binder mechanism and deforms the plate about the deformed portion for the deformed plate to capture the deformed portion of the binder mechanism. Accordingly, the fastener does not require a preformed rivet or eyelet for securing the fastener to the binder mechanism. A plurality of prongs () are formed with the plate and projecting therefrom. The prongs are used to attach the fastener to the binder by positioning the prongs adjacent a portion () of the binder and then engaging the prongs with the binder portion for the prongs to secure the fastener thereto.

21 Claims, 4 Drawing Sheets

CLINCH FASTENER FOR A RING BINDER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to ring binder mechanisms, and more particularly, to a clinch fastener for securing a ring metal of the ring binder mechanism to a spine portion of a binder.

Ring binder mechanisms use a ring metal assembly employing binder rings openable for the insertion and removal of material such as hole-punched sheets of paper, and a lever mechanism by which the rings are opened and closed. A plate covering the lever mechanism usually includes provisions at each end for attachment of the ring metal to a spine section of the binder. One form of attachment includes rivets secured to the binder and passing upward, through the ring metal. For cosmetic purposes, it is desirable to use a fastener for securing the ring binder mechanism to the binder which is not visible on the exterior surfaces of the binder. U.S. Pat. No. 5,755,513 to To, U.S. Pat. No. 5,160,209 to Schuessler, and U.S. Pat. No. 5,100,253 to Cooper each illustrate a fastener comprising an upright rivet structure mounted on a rectangular attachment plate and having a number of prongs adapted to grip an interior surface of a binder. The rivet structures in each of these patents are designed to pass through openings in the binder mechanism for attachment thereto. Prongs on the other end of the fastener then allow the ring metal/fastener subassembly to be attached to the binder spine by a pressing operation or the like.

While useful for their intended purpose, previous fastener designs have several drawbacks. For example, each fastener has a rectangular plate from which prongs are punched directly. As a result, there is more metal surrounding some prongs than others, meaning some areas of the fastener are weaker than others. Also, the rectangular configuration hinders automated assembly of the binders because fasteners must be oriented such that the longest dimension of the attachment plate is aligned along the spine of the binder.

Finally, all of these prior art fasteners require a preformed rivet or eyelet structure in order to locate the fastener in a corresponding opening in the ring metal, and secure the fastener to the ring metal by a punching or spinning operation by which an end of the rivet or eyelet is deformed about the opening to attach one end of the fastener to the ring metal. Further, the upright rivet structure used in these prior art fasteners has either a shoulder incorporated into the rivet structure itself, as is shown in the '513 patent, or requires a separate support to hold the ring metal in position as the upper surface of the rivet is deformed to secure the ring metal, as is seen in the '209 and '253 patents. Such construction adds to the overall cost of the fastener

BRIEF SUMMARY OF THE INVENTION

Among the several objects of the present invention may be noted the provision of a clinch fastener for use in securing a ring metal assembly to the spine of a binder;

the provision of such a fastener which readily attaches to the ring metal to form a subassembly and then readily attaches to the binder spine to complete the assembly;

the provision of such a fastener which is not visible once the binder is assembled so present a pleasing appearance to a user;

the provision of such a fastener to not require a rivet or eyelet to secure the fastener to the ring metal, yet still produces a secure attachement thereto;

the provision of such a fastener in which an eyelet is formed only at the time the fastener is attached to the ring metal thus to secure the fastener to the ring metal;

the provision of such a fastener to have a plurality of prongs for securely attaching the fastener to the spine;

the provision of such a fastener which is of a simple, one piece construction;

the provision of such a fastener which is a low cost, easily manufactured part that can be made in different sizes and shapes;

the provision of such a fastener which can transported and stored in bulk and which lends itself to use in automated assembly processes; and, the provision of such a fastener to attach a ring metal to a binder so the binder can be used for a long time, under strenuous conditions without falling apart In accordance with the invention, generally stated, a fastener is described for fastening a paper retaining binder mechanism to a binder. The fastener comprises a plate which is deformable to attach the fastener to the binder mechanism. This is done by abutting the plate against the binder mechanism and then striking the binder mechanism with a tool. The impact deforms a portion of the binder mechanism and deforms the plate about the deformed portion for the plate to close about and capture the deformed portion of the binder mechanism. In effect, an eyelet or rivet of the fastener is formed, but only at the time the subassembly is created. The fastener does not require a preformed eyelet or rivet.

A plurality of prongs are formed with the plate and project therefrom. The prongs attach the fastener to the binder, this being done by positioning the prongs adjacent a portion of the binder and then engaging the prongs with the binder portion with the prongs securing the fastener thereto. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
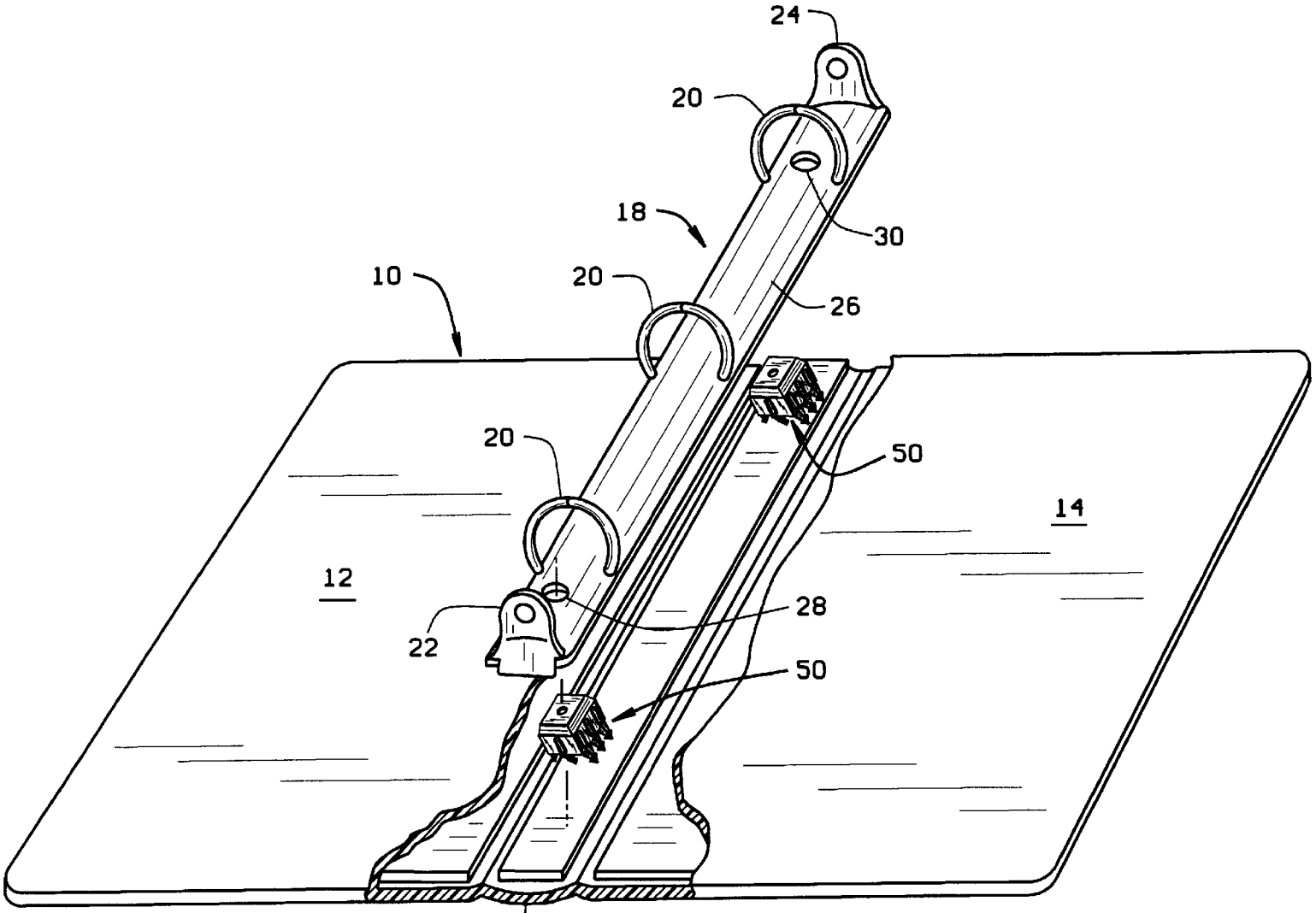
FIG. 1 is an exploded view of a ring binder mechanism, a pair of clinch fasteners of the present invention, and a binder cover, illustrating the arrangement of the components to form a completed binder.

The following detailed description illustrates the invention by way of example and not by way of limitation. The description clearly enables one skilled in the art to make and use the invention, describes several embodiments, adaptations, variations, alternatives, and uses of the invention, including what we presently believe is the best mode of carrying out the invention.

Referring to the drawings, a binder 10 for holding hole punched sheet of paper (not shown) has side leaves 12 and 14, and a center spine section 16, intermediate the leaves. A ring metal binder mechanism 18, constructed as is well-known in the art, is attached to the spine. Incorporated in the ring metal binder are a plurality of binder rings 20, and levers 21 (see FIG. 11) for opening and closing the rings in response to movement of levers 22 and 24 at respective ends of the ring metal. A metal shield 26 fits over and encloses the opening and closing mechanism. Respective openings 28, 30 are formed in shield. Heretofore, a rivet or eyelet of a fastener extended through these openings and were spun over or otherwise deformed to secure the fastener to the binder mechanism.

Figure 2:
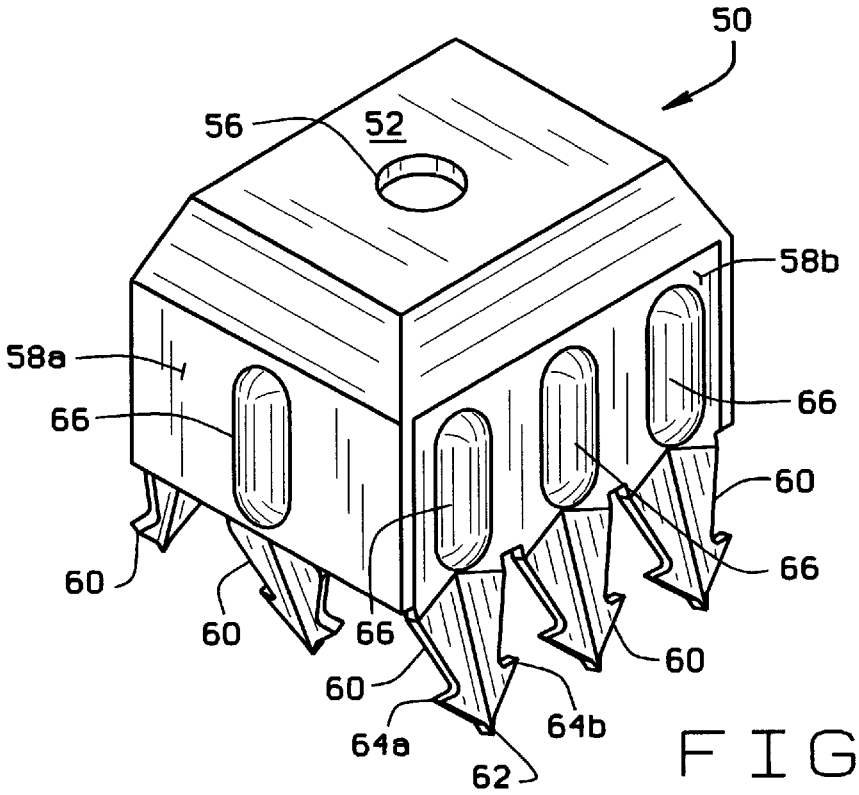
FIG. 2 is a perspective view of a first embodiment of the clinch fastener.
Figure 6:
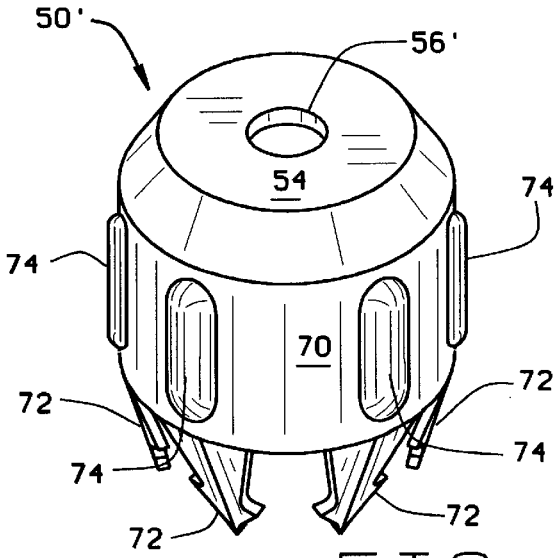
FIG. 6 is a perspective view of a second embodiment of the clinch fastener.

In accordance with the present invention, a clinch fastener 50 is provided for fastening binder mechanism 18 to spine 16 of the binder. Fastener 50 first includes a plate 52 which, as shown in FIG. 2, is a rectangular plate. In FIG. 6, a fastener 50' is shown to include a circular plate 54. Referring again to FIG. 2, fastener 50 does not include a preformed eyelet or rivet. Rather, plate 52 is deformable to attach fastener 50 to binder mechanism 18.

Figure 10:
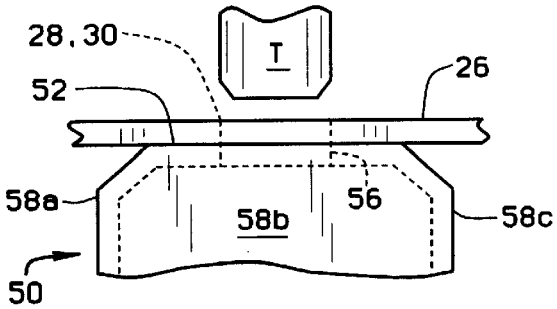
FIG. 10 is a partial elevational view of the fastener positioned for attachment to a shield of a ring binder mechanism.
Figure 11:
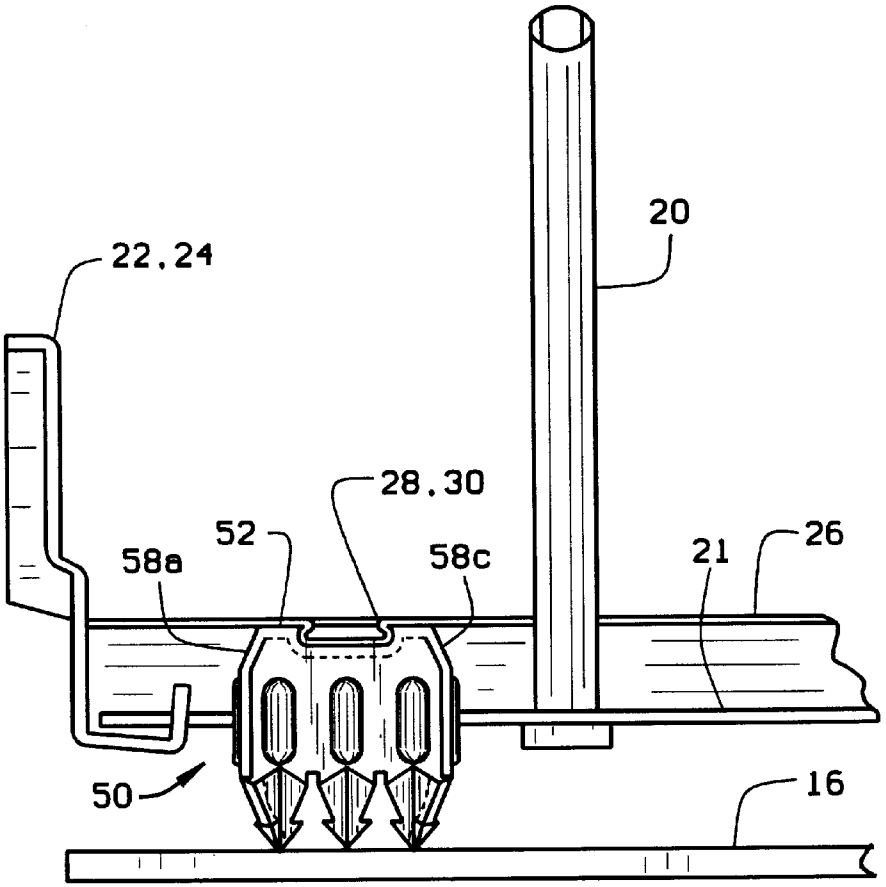
FIGS. 11 and 12 are respective side and end elevational views of a binder mechanism/fastener subassembly positioned for attachment to a spine of the binder.
Figure 12:
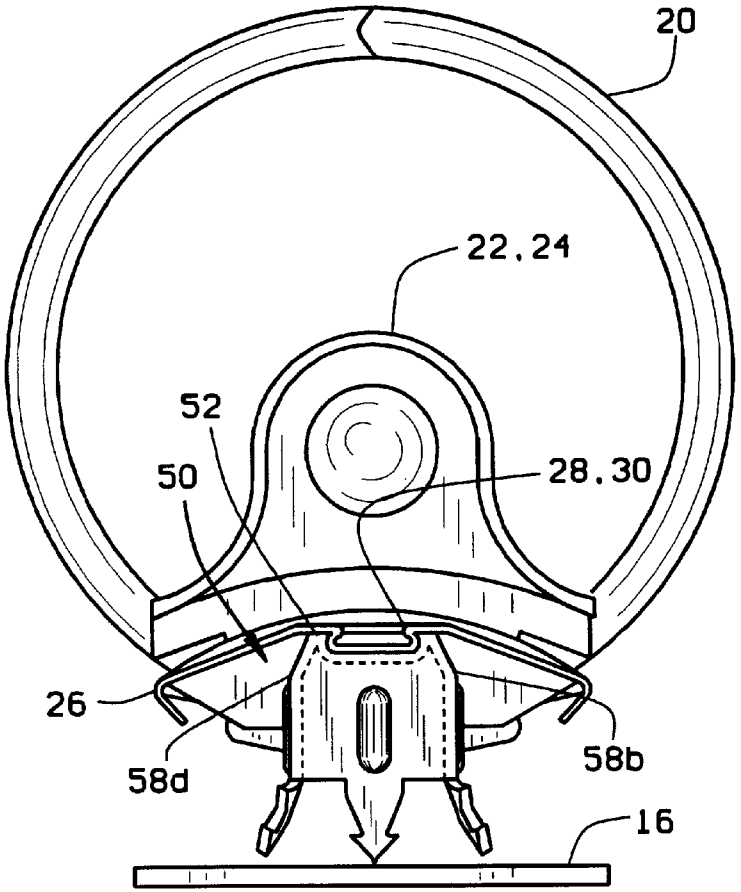

Plate 52 has a central opening 56 which is generally the same size as the opening 28, 30 in shield 26 of the binder mechanism. As shown in FIG. 10, fastener 50 is positioned beneath shield 26 so that the top of the plate abuts against the underside of the shield. The longitudinal axis of the fastener generally coincides with the longitudinal axis of the shield when the two pieces are aligned. Opening 56 is aligned with the opening 28, 30. Then a tool T is driven against the top of the shield in a punching operation or the like to deform an area about the opening 28, 30. When the area about the opening is deformed by the tool, the area about opening 56 in plate 52 is also deformed. This is as shown in FIGS. 11 and 12. The portion of plate 52 deformed by tool T folds over or envelops the corresponding deformed area of the shield. Since the plate portion of the fastener is now wrapped about a portion of the shield, the fastener is attached to the shield to form a binder mechanism/fastener subassembly. It will be understood that a fastener 50 is secured to each end of the binder mechanism as indicated in FIG. 1.

Figure 3:
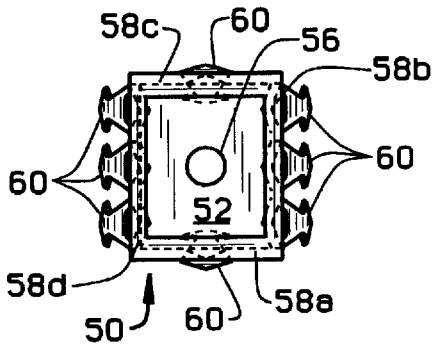
FIGS. 3–5 are respective top plan (FIG. 3) and side elevational (FIGS. 4 and 5) of the first embodiment of the fastener.
Figure 4:
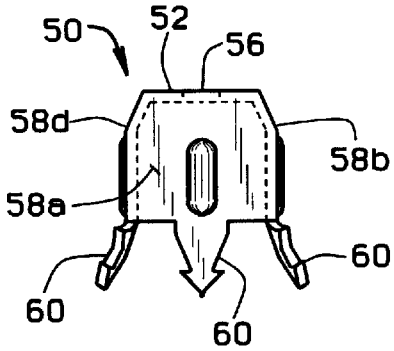
Figure 5:
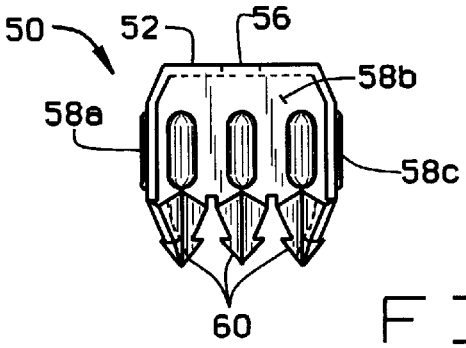
Figure 7:
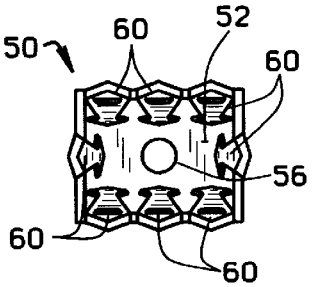
FIGS. 7–9 illustrate various orientations of attachments prongs of the fastener with respect to the fastener.
Figure 8:
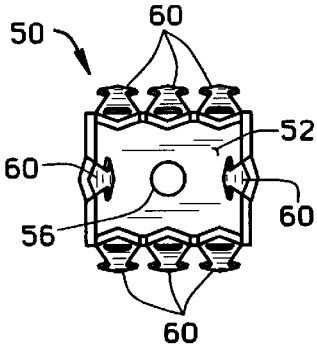
Figure 9:
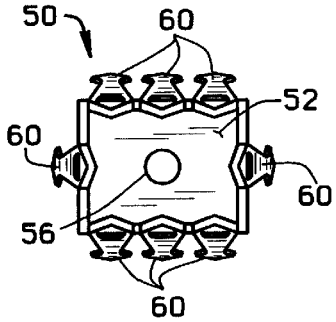

Fastener 50 includes sidewalls 58*a*–58*d* which respectively extend downward from the sides of rectangular plate 52 as shown in FIGS. 3–5. The upper portion of each sidewall flares outwardly from the respective edge of plate 52. From there, each sidewall extends vertically downward. The height of the sidewalls generally corresponds to the separation height between the shield and the binder spine. A plurality of prongs 60 are formed with plate 52 and projecting downwardly from the plate. The prongs, which are used to attach the fastener to the binder spine are formed at base of the respective sidewalls. The prongs are uniformly spaced about the fastener as particularly shown in FIGS. 7–9. As shown in FIG. 7, all the prongs can project inwardly from the base of the respective sidewalls. Or, as shown in FIG. 8, all the prongs can project outwardly. Or, as shown in FIG. 9, some of the prongs can project inwardly, while other of the prongs project outwardly.

In the drawings, eight prongs 60 are shown. Preferably, at least one prong is formed along each shorter sidewall section, and at least two prongs are formed along the longer sidewalls. Those skilled in the art will recognize that the a uniform spacing of prongs 60 provides for a uniform clinching force between the fastener and the spine when the fastener is attached to the spine. It will also be recognized that the number of prongs and their spacing about the base of the fastener can be different from the configurations shown without departing from the scope of the invention.

Figure 13:
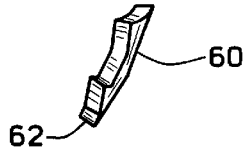
FIG. 13 illustrates the construction of a prong portion of the fastener; and, FIGS. 14A and 14B are representations of other clinch fastener constructions.

Fastener 50 is are formed by a punching or stamping operation as a single flat metal piece. Portions of the fastener are then bent and folded during subsequent manufacturing operations to form the fastener as shown in the drawings. With respect to the prong construction, as shown in FIG. 13, for example, each prong curves or angles inwardly or outwardly (depending upon the particular fastener embodiment) at an angle of approximately 20°. The lower end of each prong has a tip end 62 with a leading edge angled inwardly or outwardly an additional amount, 2° for example, from the main portion of the prong to produce a generally curved prong configuration. Each prong further includes a pair of barbs 64*a*, 64*b*, as shown in FIG. 2, to further help grip the spine and prevent clinch fastener 50 from being pulled away from the spine during the life of the binder.

During assembly, each fastener 50 is secured to spine 16 by pushing prongs 60 into the spine material. The tip ends 62 of the prongs cuts into the spine material to facilitate this cutting action as the fastener is flattened against the spine. The barbs 64*a*, 64*b*, grip the spine material and resist any force acting to pull the fastener away from the spine.

To strengthen the fastener, a plurality of ribs 66 are formed on each of the sidewalls. In FIG. 2, one rib 66 is shown formed on sidewall 58*a* of the fastener, and three sidewalls on sidewall 58*b*. In general, a rib is formed on the sidewall immediately above the location of a prong; so there is, in general, a one-to-one correspondence between the two.

Referring again to FIG. 6, fastener 50' is generally similar in construction to fastener 50. Fastener 50' has a circumferential sidewall 70 whose upper portion tapers outwardly and downwardly from plate 54, with the lower portion of the sidewall extending vertically. A plurality of prongs 72 similar in construction to the prongs 60 previously described extend from the base of sidewall 70. The prongs may all extend inwardly or outwardly, or some may extend inwardly and some outwardly. Further, strengthening ribs 74 are formed in sidewall 70; again, the rib being formed immediately above the location of each fastener. An advantage of fastener 50' is that for assembly purposes, the fastener does not have to be aligned relative to the shield before the two are attached together.

Figure 14A:
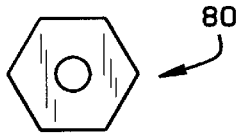
Figure 14B:
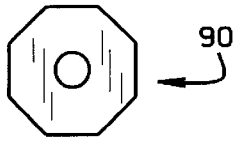

It will be understood that other fastener constructions can be implemented which do not require alignment of the fastener and shield before attachment of the two together. For example, fasteners with a square plate construction, or a hexagonal plate construction as indicated 80 in FIG. 14A, or octagonal plate construction as indicated 90 in FIG. 14B could be used. In general, any polygonally shaped plate where each side is generally of equal length with each of the other sides would work.

What has been described is a clinch fastener for use in securing a ring metal assembly to the spine of a binder. The fastener readily attaches to the ring metal to form a subassembly and then readily attaches to the binder spine to complete the assembly. Once the assembly is completed, the fastener is not visible. Importantly, the fastener does not require a preformed rivet or eyelet for securing the fastener to the ring metal. The fastener has a plurality of prongs for securely attaching the fastener to the binder spine. Rather, an eyelet is formed only at the time the fastener is attached to the ring metal to secure the fastener to the ring metal.

The fastener is of a simple, one piece construction, which is low cost and easy to manufacture in different sizes and shapes. For production purposes, the fastener can be transported and stored in bulk and the fastener lends itself to automated assembly processes.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. A fastener for fastening a paper retaining binder mechanism to a binder comprising:

a plate deformable to attach said fastener to said binder mechanism by abutting said plate against said binder mechanism and then striking said binder mechanism with a tool which deforms a portion of said binder mechanism and deforms said plate about said deformed portion for said deformed plate to capture said deformed portion; and, a plurality of prongs formed with said plate and projecting therefrom for attaching said fastener to the binder by positioning said prongs adjacent a portion of the binder and then engaging said prongs with said binder portion for said prongs to secure said fastener thereto.

2. The fastener of claim 1 wherein said plate is a rectangular plate having a central opening therein for aligning said fastener with a corresponding opening in said binder mechanism, said deformed portion of said binder mechanism being an area about said opening.

3. The fastener of claim 1 wherein said plate is a round plate having a central opening therein for aligning said fastener with a corresponding opening in said binder mechanism.

4. The fastener of claim 2 or 3 wherein a circumferential area about said central opening is deformed about a corresponding area of said binder mechanism, said circumferential area encompassing said area of said binder mechanism to attach said fastener to said binder mechanism.

5. The fastener of claim 1 further including a sidewall formed with said plate and extending generally orthogonally of said plate, said prongs projecting from said sidewall.

6. The fastener of claim 5 wherein said plate is a rectangular plate and a sidewall extends orthogonally from each side of said plate.

7. The fastener of claim 6 wherein at least one prong extends from each sidewall for attaching said fastener to said binder.

8. The fastener of claim 7 wherein at least two prongs extend from each sidewall extending from the longer side of said rectangular plate.

9. The fastener of claim 8 wherein each prong has a tip end for penetrating said portion of said binder, said tip ends of said prongs having barbs formed thereon.

10. The fastener of claim 1 further including reinforcing means reinforcing said fastener to strengthen said fastener.

11. The fastener of claim 10 wherein said reinforcing means includes a strengthening rib formed on said fastener at a location adjacent that of each prong.

12. A ring binder comprising:

a binder cover including respective end leaves and an intermediate spine section;

a binder mechanism attached to said spine section and including a plurality of openable and closeable binder rings, means for opening and closing said rings, and a cover plate for said rings and said means; and, at least one fastener for fastening said binder mechanism to said spine section, said fastener including:

a plate deformable to attach said fastener to said binder mechanism by abutting said plate against said binder mechanism and then striking said binder mechanism with a tool which deforms a portion of said binder mechanism and deforms said plate about said deformed portion for said deformed plate to capture said deformed portion; and, a plurality of prongs formed with said plate and projecting therefrom for attaching said fastener to the binder by positioning said prongs adjacent a portion of the binder and then engaging said prongs with said binder portion for said prongs to secure said fastener thereto.

13. The ring binder of claim 12 including a pair of fasteners one of which is used to fasten each end of said binder mechanism to said spine section.

14. The ring binder of claim 13 wherein said plate is a rectangular plate having a central opening therein for aligning said fastener with a corresponding opening in said binder mechanism.

15. The ring binder of claim 14 wherein a circumferential area about said central opening is deformed about a corresponding area of said binder mechanism, said circumferential area encompassing said area of said binder mechanism to attach said fastener to said binder mechanism.

16. The ring binder of claim 15 wherein a sidewall extends orthogonally from each side of said plate.

17. The ring binder of claim 16 wherein at least one prong extends from each sidewall for attaching said fastener to said binder.

18. The ring binder of claim 17 wherein each prong has a tip end for penetrating said portion of said binder, said tip ends of said prongs having barbs formed thereon.

19. The ring binder of claim 18 further including reinforcing means reinforcing said fastener to strengthen said fastener.

20. The ring binder of claim 19 wherein reinforcing means includes a strengthening rib formed on each of said sidewalls at a location immediately above that of a prong.

21. A fastener for fastening a paper retaining binder mechanism to a binder comprising:

a plate deformable to attach said fastener to said binder mechanism by abutting said plate against said binder mechanism and then striking said binder mechanism with a tool which deforms a portion of said binder mechanism and deforms said plate about said deformed portion for said deformed plate to capture said deformed portion, said plate being a polygonally shaped plate whose sides are generally equal in length; and, a plurality of prongs formed with said plate and projecting therefrom for attaching said fastener to the binder by positioning said prongs adjacent a portion of the binder and then engaging said prongs with said binder portion for said prongs to secure said fastener thereto.

* * * * *